US005345862A

United States Patent [19]

Giard

[11] Patent Number: 5,345,862

[45] Date of Patent: Sep. 13, 1994

[54] DOCTOR BLADE CARRIER INTENDED MAINLY FOR A SILK-SCREEN PRINTING MACHINE

[76] Inventor: Dominique Giard, 3 rue Denis Poisson, 75017 Paris, France

[21] Appl. No.: 72,992

[22] Filed: Jun. 7, 1993

[30] Foreign Application Priority Data

Jun. 5, 1992 [FR] France ..... 92 06869

[51] Int. Cl.[5] ..... B05C 17/04

[52] U.S. Cl. ..... 101/123; 15/245

[58] Field of Search ..... 101/123, 124, 114, 115; 15/245; 718/256, 263

[56] References Cited

U.S. PATENT DOCUMENTS

| | | | |
|---|---|---|---|
| 3,071,069 | 1/1963 | Sherman | 101/123 |
| 4,102,266 | 7/1978 | Porth | 101/124 |
| 4,841,854 | 6/1989 | Bubley | 101/123 |
| 4,989,511 | 2/1991 | Clarke, Jr. | 101/123 |
| 5,078,063 | 1/1992 | Johansen et al. | 101/123 |

FOREIGN PATENT DOCUMENTS

| | | | |
|---|---|---|---|
| 0167906 | 1/1986 | European Pat. Off. . | |
| 1034659 | 7/1958 | Fed. Rep. of Germany | 101/123 |
| 8709832 | 4/1988 | Fed. Rep. of Germany . | |
| 56-120349 | 9/1981 | Japan . | |
| 0231754 | 10/1987 | Japan | 101/123 |
| 376083 | 5/1964 | Switzerland . | |
| 1498267 | 1/1978 | United Kingdom | 101/123 |

*Primary Examiner*—Eugene H. Eickholt
*Attorney, Agent, or Firm*—Young & Thompson

[57] ABSTRACT

The invention relates to a doctor blade carrier intended particularly for a silk-screen printing machine, wherein it has a first pair of fastening reliefs (**13*a*, 13*b*) arranged facing each other; a second pair of fastening reliefs (14*a*, 14*b*) arranged facing each other; the reliefs of the first and second pairs (13*a*, 13*b*, 14*a*, 14*b*) being respectively complementary to one another so as to be able to interact with each other in a removable fashion; one of the two pairs of reliefs (13*a*, 13*b*, 14*a*, 14*b*) having a double plurality of similar successive reliefs, the same clamping means (10, 15) allowing the angular locking of the vise (5) with respect to the base (6) about the main axis (12**) between two limiting positions.

7 Claims, 3 Drawing Sheets

DOCTOR BLADE CARRIER INTENDED MAINLY FOR A SILK-SCREEN PRINTING MACHINE

FIELD OF THE INVENTION

The invention relates to a doctor blade carrier.

PRIOR ART

Specific doctor blade carriers are known, including a groove of the thickness of the doctor blade, but not allowing the angle of attack to be adjusted (in particular see: CH-A-376,083, DE-U-8,709,832, JP-A-5 6,120,349, US-A-4,989,511, EP-A-0,167,906, US-A-4,940,354, US-A-4,648,371, US-A-4,841,854, US-A-4,102,266, DE-A-1,536,985).

The objects of the invention is to adjust both the thickness of the doctor blade carrier, the angle of attack of the doctor blade, its stiffness and to reinforce its ends.

SUMMARY OF THE INVENTION

To this end, the invention proposes a doctor blade carrier of the type forming the subject of the preamble of the main claim, wherein said doctor blade carrier has a first pair of fastening reliefs located on two branches extending jaws; a second pair of fastening reliefs located on support means carried by a base; said reliefs being complementary so as to interact in a removable fashion; one of the pairs of reliefs having a double plurality of successive reliefs; clamping means allowing the angular blocking of the vise carrying the doctor blade with respect to the base intended to be fixed to the chassis of a machine or intended to be manoeuvred; the support means being rigidly fixed to the base and having the form of two half-cylinders where the two pluralities of reliefs are located; each branch having an overall shape of a quarter cylinder and the two branches being capable of enveloping the support means.

BRIEF DESCRIPTION OF THE DRAWINGS

The invention will be better understood from reading the description which follows, with reference to the appended drawings in which.

DESCRIPTION OF THE PREFERRED EMBODIMENT

Figure 1:
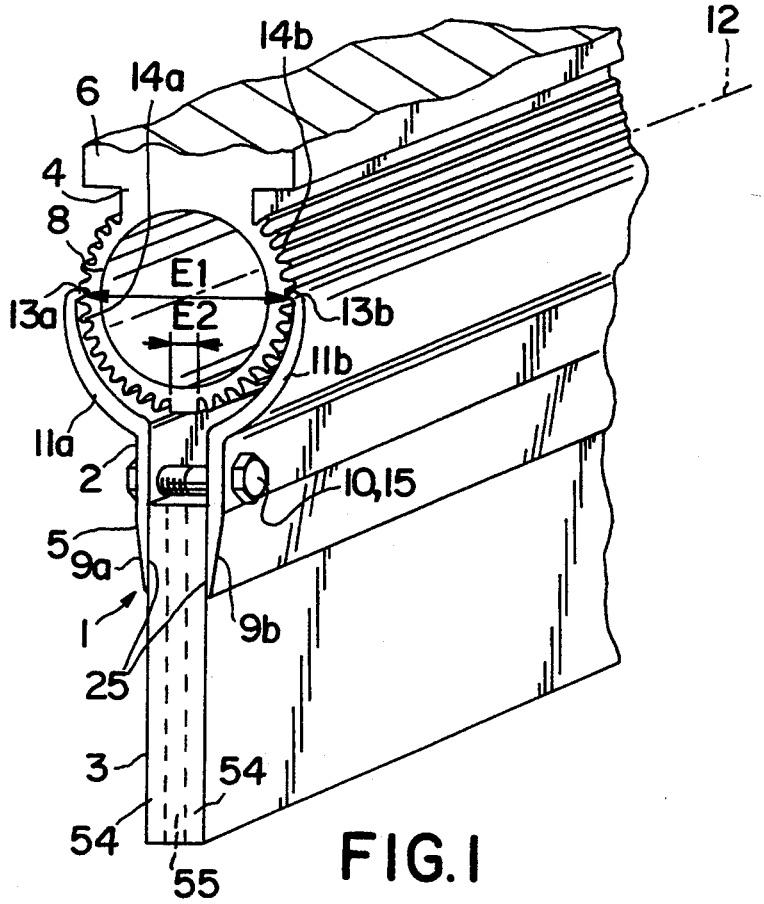
FIG. 1 is a partial perspective view of one variant of a wiping assembly.

The wiping assembly 1 comprises a doctor blade carrier 2 to which is rigidly and removably fixed a doctor blade 3 (or two doctors blades 3*a*, 3*b*). The doctor blade carrier 2 comprises a body 4 and a vise 5. The body 4, which is rigid, includes a base 6 particularly intended to be fixed to the chassis 7 of a machine, and support means 8.

The vise 5 comprises two jaws 9*a*, 9*b* and clamping means 10. Two branches 11*a*, 11*b* extend the jaws 9*a*, 9*b* and extend away from each other so as to be clipped in to the support means 8 by means of complementary fastening reliefs. The wiping assembly 1 has a main axis 12 with respect to which the doctor blade carrier 2 and the doctor blade 3 are shaped, and two planes of symmetry P (base 6, support means 8 ) and Q (vise 5, doctor blade 3 ) capable of pivoting with respect to the plane P over a maximum travel of 90°.

A first pair of fastening reliefs 13*a*, 13*b* arranged facing each other are located on the branches 11*a*, 11*b* at their end parts. A second pair of fastening reliefs 14*a*, 14*b*, arranged facing them, are located on the support means 8. The reliefs 13*a*, 14*a*, 13*b*, 14*b* are respectively complementary so as to interact in a removable fashion.

One of the two pairs of reliefs (in this case 14*a*, 14*b*) has a double plurality of similar successive reliefs. The spacing between two facing symmetric reliefs varies in a discrete fashion from a maximum value E1 to a minimum value E2.

The clamping means 15, structurally coincident with the means 10 allow the angular blocking, about the axis 12, of the vise 5 with respect to the base 6 between two limiting positions.

Two pairs of projecting reliefs 13*a*, 13*b* pointing towards one another, and a double plurality of successive hollow reliefs 14*a*, 14*b* with variable spacing, pointing back-to-back, are provided.

Figure 8:
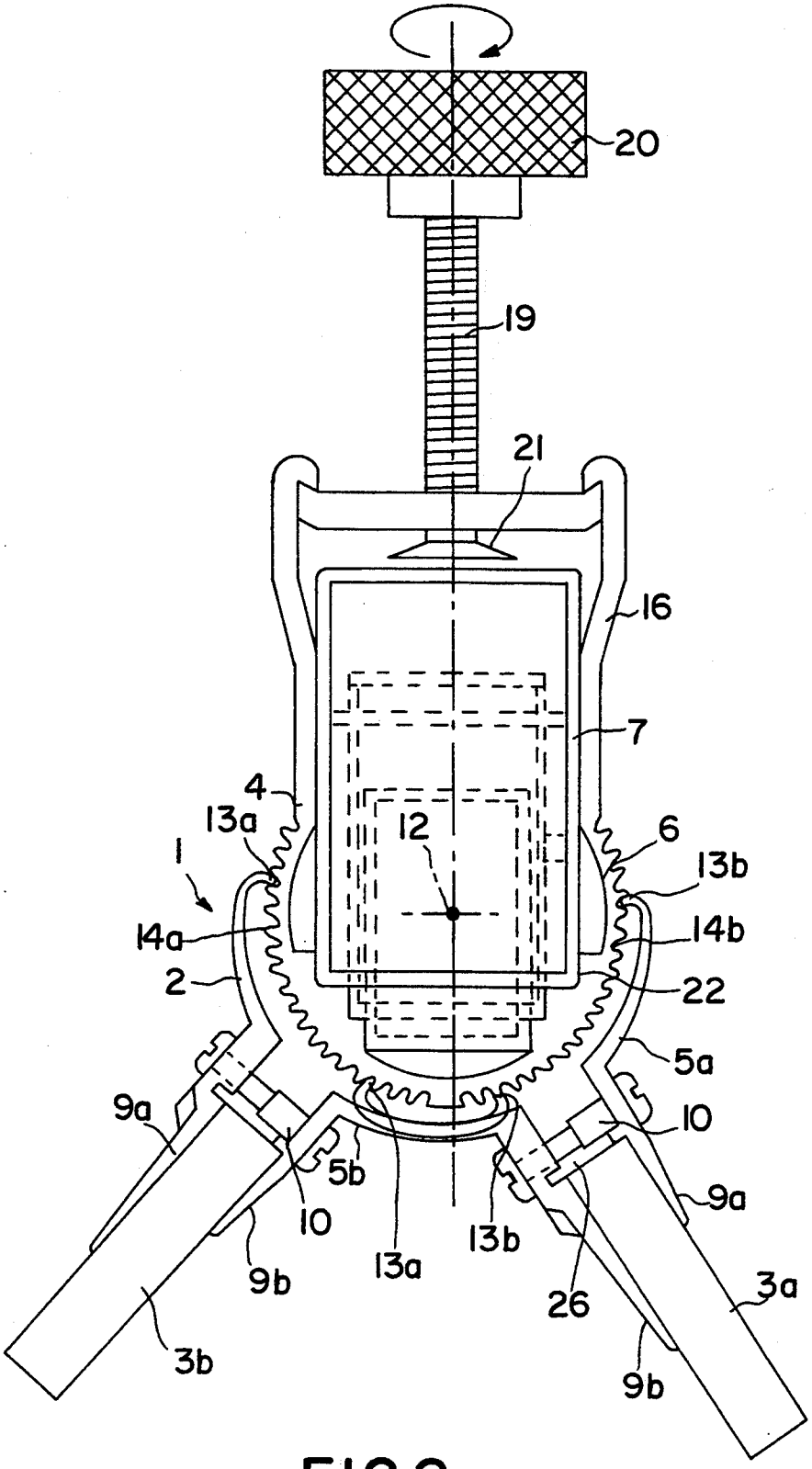
FIG. 8 is a transverse sectional view of a silk-screen printing machine part including a wiping assembly with two doctor blades.

A caliper 16 forming the base 6 at its end part is provided (FIG. 8). Blocking on the chassis 7 is produced by a threaded rod 19 passing through a tapped hole of the caliper opposite the base 6, the rod ending in a manoeuvreing member 20 and in a support plate 21 coming onto one side of the chassis 7, the other side of which comes to interact with a recess 22 in the internal face of the base 6 (or, optionally, a plurality of recesses 22 for different chassis 7).

Figure 7:
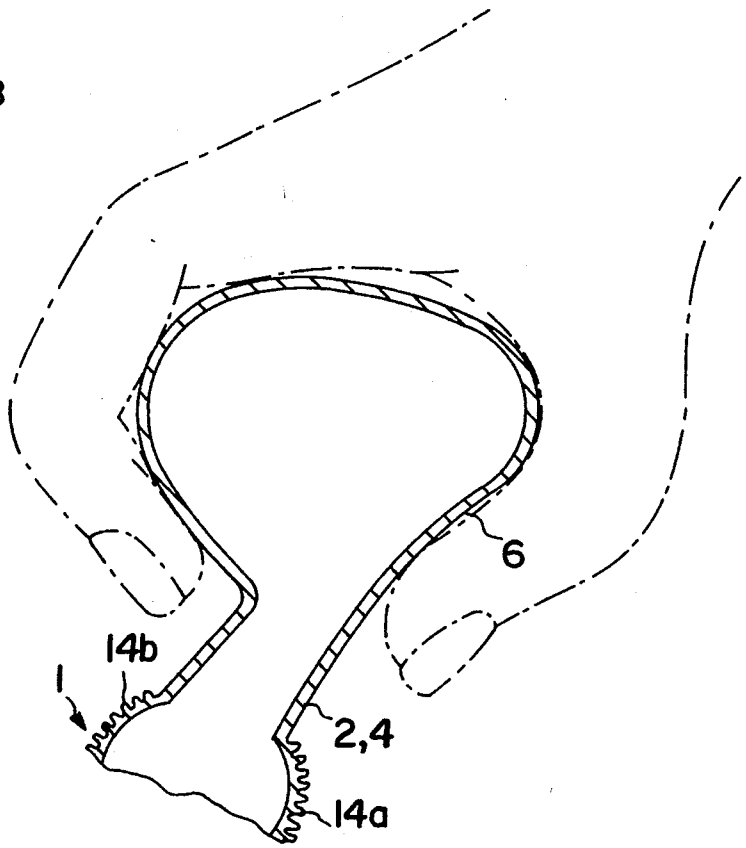
FIG. 7 is a partial axial end view illustrating another embodiment in which the base of the body is intended to be manoeuvred, the user's hand being represented in chain line.

The base 6 may be intended to be manoeuvred by being exhibited in the form of handle (FIG. 7).

Figure 2:
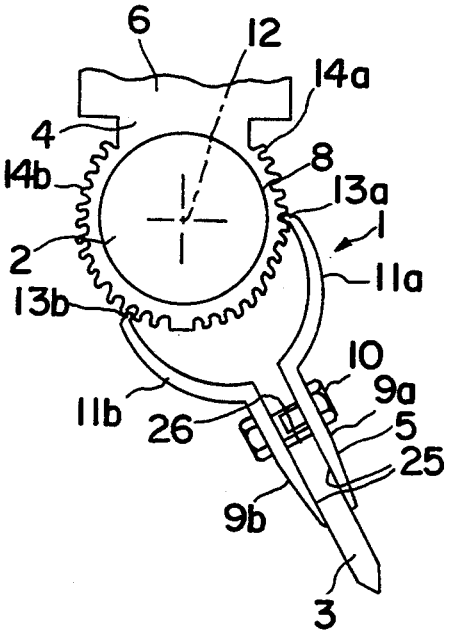
FIGS. 2 and 3 are two diagrammatic axial end views of the assembly of FIG. 1 in two different adjustment situations (thickness and angle)
Figure 3:
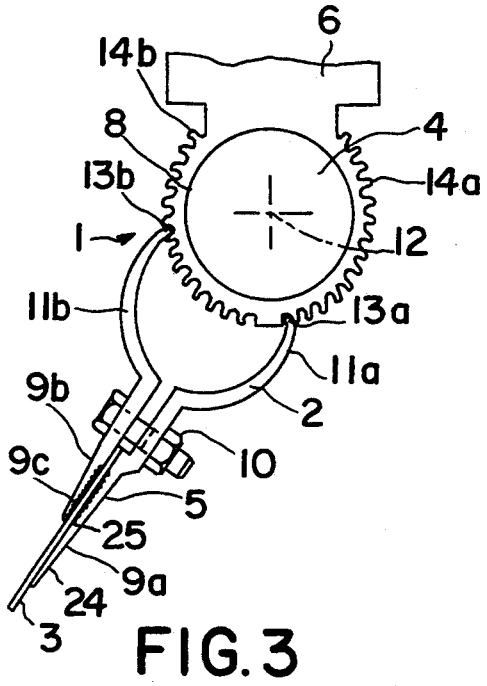

In FIGS. 1 and 2, the two jaws 9*a*, 9*b* are of the same length. In FIG. 3, they are dissimilar, one of them, 9*a*, having an extension 24. At least one of the jaws 9*a*, 9*b* comprises, on its internal face 25, a stop 26 for the doctor blade 3 and, at its end part, reliefs 9*c* for holding the doctor blade 3. The two faces 25 are parallel or substantially parallel.

Figure 4:
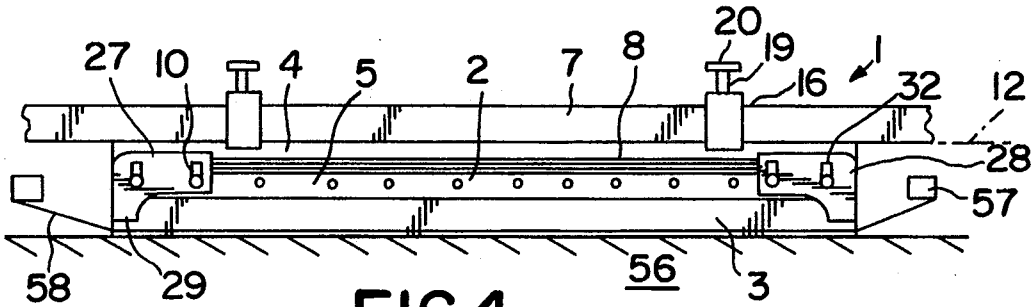
FIG. 4 is an elevation view of a silk-screen printing machine part including a wiping assembly and reinforcing means.
Figure 6:
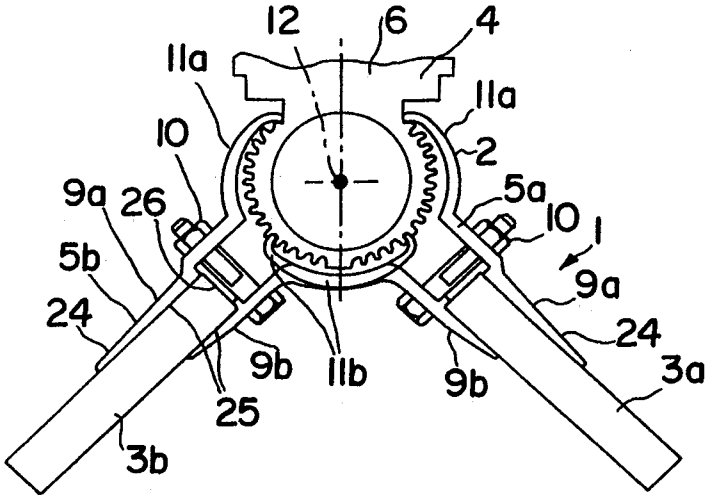
FIG. 6 is an axial end view of another embodiment comprising a single body, two imbricated vises, and two doctor blades.
Figure 5:
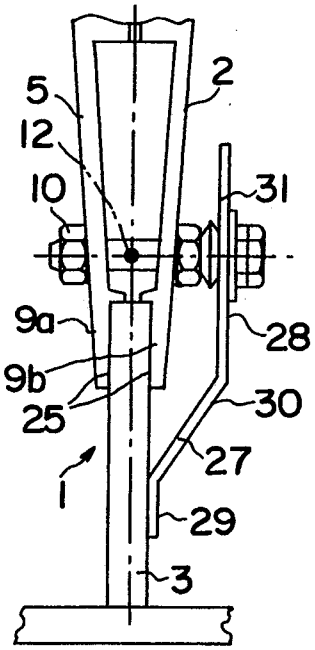
FIG. 5 is an axial end view of FIG. 4 on a larger scale.

The doctor blade carrier 2 includes (FIGS. 4 and 5) at least one shaped reinforcing plate 27 having a fixing part 28, a support part 29, and a cutaway 30 between them. Elasticity means 31 provide elasticity of the mounting of the plate 27 on the vise 5 and are mounted on the clamping means 10 passing through the slots 32 in the plate 27 and allowing adjustment. The doctor blade carrier 2 includes (FIG. 6) on one and the same body 4, two vises 5*a*, 5*b* which are imbricated and inclined with respect to each other, the two doctor blades 3*a* and 3*b* (or doctor blade support) operating in opposite directions.

The support means 8, rigidly fixed to the base 6, are two half cylinders in extension. The reliefs 14*a*, 14*b* are located on their external faces. The branches 11*a*, 11*b* each have an overall shape of a quarter cylinder and carry the reliefs 13*a*, 13*b* at their free end on the internal face. They have a curvature and dimension such that they envelop the support means 8 from the outside.

A relief 14*a*, 14*b* is delimited by a concave bottom more or less corresponding to a half cylinder and, on either side, a concave part and a convex part moving apart towards an opening. A relief 13*a*, 13*b* has a shape of a curved finger ending in a ball joint projecting towards the underside and capable of interacting with the concave bottom of the relief 14*a*, 14*b*. The underside and the upper side of the finger may be tangential to the convex and concave parts of the relief 14*a*, 14*b* in the limiting positions of the branches 11*a*, 11*b*. Reliefs 14*a*, 14*b* are separated by a constant angular pitch corresponding to the angular value of the adjustment of the angle of the doctor blade 3 (in this case 4°30').

A doctor blade 3 (FIG. 1) has two outer layers, on either side, containing molybdenum disulfide capable of decreasing the friction, or any other equivalent material, and at least one internal, more rigid layer, particularly reinforced and/or including one or more copolymers.

A machine including a wiping assembly 1 (FIG. 4) comprises a table 56 above which is mounted the wiping assembly 1. Lateral supports 57 allow the fixing of a silk-screen printing screen 58 onto which the doctor blade 3 bears. The reinforcing plates 27 are located near the supports 57.

Optionally, identification means are provided making it possible to place the doctor blade with the desired angle.

I claim:

1. A doctor blade carrier intended mainly for a silk-screen printing machine, printing machine, or other similar application, and comprising a body (4) whose base (6) is intended to be gripped and moved; a vise (5) for removably fixing a doctor blade (3) and having two jaws (9*a*, 9*b*) with which are associated clamping means (10), wherein said doctor blade carrier has a first pair of projecting fastening reliefs (13*a*, 13*b*) arranged facing each other and located at the ends of two branches (11*a*, 11*b*) extending the jaws (9*a*, 9*b*) having the shape of a quarter cylinder; a second pair of a plurality of hollow fastening reliefs (14*a*, 14*b*) arranged facing each other and located on support means (8) fixed to the base (6), having the shape of two half cylinders in extension, the spacing between two reliefs (14*a*, 14*b*) facing each other varying in a discrete fashion from a maximum value (E1) to a minimum value (E2), the reliefs (13*a*, 13*b*, 14*a*, 14*b*) being complementary so as to interact in a removable fashion; the same clamping means (10, 15) allowing the angular blocking of the vise (5) with respect to the base (6) about the main axis (12) between two limiting positions; the base (6) being intended to be fixed to the chassis (7) of the machine.

2. The doctor blade carrier as claimed in claim 1, wherein the two jaws (9*a*, 9*b*) of the vise (5) are either of the same length, or dissimilar, one having an extension (24); at least one of the laws (9*a*, 9*b*) comprises, on its internal face (25), a stop (26) for the doctor blade (3); a jaw (9*a*, 9*b*) comprising, on its internal face (25) and its end part, reliefs (9*c*) for holding the doctor blade (3); a hollow relief (14*a*, 14*b*) being delimited by a concave bottom and, on either side, a concave part and a convex part moving away from one another from the opening of the hollow (14*a*, 14*b*); a projecting relief (13*a*, 13*b*) having an overall shape of a curved finger ending in a ball joint projecting towards the underside, and capable of interacting with said concave bottom; the upper side and the underside of the finger being capable of being substantially tangential to said concave part and said convex part of the hollow relief (14*a*, 14*b*) in the limiting positions of the branches (11*a*, 11*b*).

3. The doctor blade carrier as claimed in claim 1, wherein it includes at least one localized reinforcement (27) exhibited in the form of a shaped plate having a fixing part (28), a support part (29) and a cutaway (30); elasticity means (31) providing a certain elasticity of the mounting of this plate (27) on the vise (5); a reinforcing plate (27) being located at at least one of the axial end parts of the machine.

4. The doctor blade carrier as claimed in claim 1, wherein it includes, on one and the same body (4), two vises (5*a*, 5*b*) imbricated with each other by virtue of complementary cutouts in their branches (11*a*, 11*b*) which are inclined with respect to each other.

5. The doctor blade carrier as claimed in claim 1, wherein it has a doctor blade (3) having two outer layers on each side containing molybdenum disulfide capable of decreasing the friction, or equivalent, and a more rigid inner layer, particularly reinforced and/or including one or more copolymers.

6. The doctor blade carrier as claimed in claim 1, wherein said base (6) has a recess (22) therein for receiving a portion of said chassis (7).

7. The doctor blade carrier as claimed in claim 1, the base (6) having a handle by which the base can be manually maneuvered.

* * * * *